US009005098B2

(12) United States Patent
Ziemba

(10) Patent No.: US 9,005,098 B2
(45) Date of Patent: Apr. 14, 2015

(54) CONTAINER AND METHOD FOR FACILITATING DISPOSAL OF UNUSED PHARMACEUTICAL PRODUCT

(71) Applicant: Mallinckrodt LLC, Hazelwood, MO (US)

(72) Inventor: Robert J. Ziemba, Cincinnati, OH (US)

(73) Assignee: Mallinckrodt LLC, Hazelwood, MO (US)

( * ) Notice: Subject to any disclaimer, the term of this patent is extended or adjusted under 35 U.S.C. 154(b) by 0 days.

(21) Appl. No.: 13/925,680

(22) Filed: Jun. 24, 2013

(65) Prior Publication Data

US 2013/0283734 A1 Oct. 31, 2013

Related U.S. Application Data

(62) Division of application No. 13/015,490, filed on Jan. 27, 2011, now Pat. No. 8,490,795.

(60) Provisional application No. 61/300,189, filed on Feb. 1, 2010.

(51) Int. Cl.

| | |
|---|---|
| ***B65B 3/04*** | (2006.01) |
| ***A61J 1/00*** | (2006.01) |
| ***B65B 53/02*** | (2006.01) |

(52) U.S. Cl.

CPC ... *B65B 3/04* (2013.01); *A61J 1/00* (2013.01); *B65B 53/02* (2013.01)

(58) Field of Classification Search

CPC ..... A61J 1/00
USPC ..... 588/249, 249.5
See application file for complete search history.

(56) References Cited

U.S. PATENT DOCUMENTS

| | | | | |
|---|---|---|---|---|
| 4,653,643 | A | 3/1987 | Black | |
| 4,702,738 | A * | 10/1987 | Spencer | 604/198 |
| 4,919,569 | A | 4/1990 | Wittenzelliner | |
| 4,920,912 | A | 5/1990 | Kirkling | |
| 5,109,984 | A | 5/1992 | Romick | |
| 5,334,178 | A | 8/1994 | Haber et al. | |
| 5,401,444 | A * | 3/1995 | Spinello | 264/0.5 |
| 5,519,931 | A * | 5/1996 | Reich | 29/426.3 |
| 5,525,299 | A | 6/1996 | Lowe | |

(Continued)

FOREIGN PATENT DOCUMENTS

| | | |
|---|---|---|
| WO | 2005080060 | 9/2005 |

*Primary Examiner* — John Kreck
(74) *Attorney, Agent, or Firm* — James L. Johnson; Marsh Fischmann & Breyfogle LLP

(57) ABSTRACT

Containers and methods for disposing unused pharmaceutical product are disclosed. Each container (100, 200, 300) may include a container body (104, 204, 304) with an internal chamber (116, 216, 316) for storing pharmaceutical product, along with a cover (124, 224, 324) for selectively limiting access to the chamber (116, 216, 316). An encapsulation component (128, 228, 328) may be selectively disposable within the chamber (116, 216, 316), and may be operable to encapsulate the pharmaceutical product within the container (100, 200, 300). For instance, the encapsulation component (128, 228, 328) may melt and/or flow into contact with the pharmaceutical product and thereafter solidify to encapsulate the pharmaceutical product. The encapsulation component (128, 228, 328) may melt and thereafter solidify between the cover (124, 224, 324) and shell (104, 204, 304) to limit removal of the cover (124, 224, 324) from the shell (104, 204, 304).

20 Claims, 6 Drawing Sheets

(56) References Cited

U.S. PATENT DOCUMENTS

| | | | | |
|---|---|---|---|---|
| 5,860,419 | A | 1/1999 | Davies et al. | |
| 6,010,444 | A | 1/2000 | Honeycutt et al. | |
| 6,087,548 | A * | 7/2000 | Levy et al. | 588/255 |
| 6,158,613 | A | 12/2000 | Novosel et al. | |
| 6,373,786 | B1 | 4/2002 | Kagan et al. | |
| 7,081,807 | B2 | 7/2006 | Lai | |
| 7,392,918 | B2 | 7/2008 | Holloway et al. | |
| 7,416,540 | B2 | 8/2008 | Edwards et al. | |
| 7,615,271 | B2 * | 11/2009 | Hetzler et al. | 428/35.7 |
| 7,867,511 | B2 | 1/2011 | Anderson et al. | |
| 7,931,022 | B2 | 4/2011 | Johnson et al. | |
| 8,236,238 | B2 | 8/2012 | Uhland et al. | |
| 2006/0037663 | A1 | 2/2006 | Haimi | |
| 2007/0194890 | A1 | 8/2007 | Brue | |
| 2009/0180936 | A1 | 7/2009 | Anderson et al. | |
| 2009/0234331 | A1 | 9/2009 | Langereis et al. | |
| 2010/0326020 | A1 | 12/2010 | Schmaelzle et al. | |
| 2011/0012742 | A1 | 1/2011 | Johnson | |
| 2011/0132795 | A1 | 6/2011 | Silverman | |
| 2011/0226817 | A1 | 9/2011 | Ortenzi et al. | |
| 2011/0272428 | A1 | 11/2011 | Ziemba et al. | |

* cited by examiner

CONTAINER AND METHOD FOR FACILITATING DISPOSAL OF UNUSED PHARMACEUTICAL PRODUCT

CROSS-REFERENCE TO RELATED APPLICATIONS

This patent application is a divisional patent application of and claims priority to U.S. patent application Ser. No. 13/015,490, filed on Jan. 27, 2011, which is a non-provisional application of and claims priority to U.S. Provisional Patent Application Ser. No. 61/300,189, entitled "CONTAINER AND METHOD FOR FACILITATING DISPOSAL OF UNUSED PHARMACEUTICAL PRODUCT," filed on Feb. 1, 2010. The entire disclosure of each patent application set forth in this Related Applications section is incorporated by reference in its entirety.

FIELD OF THE INVENTION

The present invention generally relates to the field of containers and packaging for pharmaceutical products such as pills, capsules, patches, and the like and, more particularly, to containers and packaging that are configured to facilitate the disposal of pharmaceutical products (e.g., to reduce the potential of illicit usage of unused pharmaceutical product).

BACKGROUND

Abuse, misuse, and overdose of pharmaceutical products (e.g., pain management drugs) are serious health concerns that affect many people on a daily basis all over the world. For instance, diversion and subsequent misuse or abuse may occur when a patient gets a prescription for a pharmaceutical product and does not use all of the pharmaceutical product for whatever reason (e.g., a doctor may prescribe a pharmaceutical product for a patient and advise the patient to take the pharmaceutical product on an "as needed" basis; a patient may be advised to use an entire prescribed amount of pharmaceutical product, but may unilaterally decide to discontinue use of the pharmaceutical product as one or more symptoms disappear). In any case, remaining pharmaceutical product may be ultimately acquired by an individual other than for whom the pharmaceutical product was originally prescribed (e.g., transferred by the original patient to another individual, such as family member or friend; stolen). While unused pharmaceutical product may be disposed of in the trash, this may not be viewed by some as a secure method of disposal.

In the case of transdermal analgesic patches, a used patch may still retain a significant amount of active ingredient in the patch. A used patch can be very dangerous and can even lead to death for people who have not been prescribed the patch. While some patch manufacturers recommend flushing used patches down the toilet, this practice has raised concerns about drug product entering the water supply. In some states, "take back" programs have been instituted, allowing users to request shipping materials in order to ship used or unused pharmaceutical product (e.g., patches, pills, capsules, etc.) to a certified disposal company. These programs are costly and require several actions by the patient at multiple times.

SUMMARY

A first aspect of the present invention is embodied by a pharmaceutical product container including a container body, an access member that is detachably connectable with the container body and movable between open and closed positions, a chamber, pharmaceutical product (e.g., in the form of one or more pills, capsules, caplets, tablets, transdermal patches, or the like) within the chamber, and a heat-activated encapsulation material or component (e.g., layer, sleeve) that may be disposed in the chamber. All pharmaceutical product within the chamber is unused pharmaceutical product (e.g., pharmaceutical product that has not been part of or used in any dosing event; pharmaceutical product in its originally prescribed form; pharmaceutical product in its originally administrable form). The container body has a first melting temperature, and the heat-activated encapsulation material has a second melting temperature that is lower than the first melting temperature of the container. Heating the container to at least the second melting temperature (e.g., a temperature between the first and second melting temperatures) activates the encapsulation material (e.g., allows the encapsulation material to melt) so as to at least partially encapsulate the pharmaceutical product.

A second aspect of the present invention is embodied by a pharmaceutical product container including a container body having a first melting temperature, a chamber that at least partially exists within the container body, pharmaceutical product within the chamber, an access member that is removably connectable to the container body for selectively allowing access to the pharmaceutical product, and a heat-activated encapsulation material. The heat-activated encapsulation material has a second melting temperature that is less than the first melting temperature of the container. Moreover, the heat-activated encapsulation material is separately incorporated on a portion of the access member that is configured to interface with the chamber in which the pharmaceutical product is disposed.

A third aspect of the present invention is embodied by a pharmaceutical product container that includes a container body, pharmaceutical product, and an access member. The access member is removably connectable to the container body and includes an access member body and a heat-activated encapsulation material. The access member body includes inside and outside surfaces, where the inside surface is able to face the pharmaceutical product within the container body (e.g., when the access member is in a closed position). The heat-activated encapsulation material is disposed on the inside surface of the access body member and has a second melting temperature that is less than a first melting temperature of the container body.

A number of feature refinements and additional features are separately applicable to each of the first, second, and third aspects of the present invention. These feature refinements and additional features may be used individually or in any combination in relation to each of the first, second, and third aspects of the present invention. As such, each of the following features that will be discussed may be, but are not required to be, used with any other feature or combination of features of the first, second, and third aspects, respectively. The following discussion is separately applicable to each of the first, second, and third aspects, up to the start of the discussion of a fourth aspect of the present invention.

The container body may be of any appropriate size, shape, configuration, and/or type. The container body may be in the form of a shell or an outer structure (e.g., substantially box-shaped or cylindrical receptacle), and furthermore a chamber may be disposed inside the container body (e.g., the chamber may be characterized as being defined within the container body). The chamber may be appropriately sized to contain, hold, and/or store a desired amount of pharmaceutical product. Although "pharmaceutical product" may sometimes be used herein (i.e., instead of "one or more pharmaceutical products"), it should be appreciated that use of the phrase "pharmaceutical product" may signify one or more individual pharmaceutical components (e.g., one or more pills, one or more capsules, one or more caplets, one or more tablets, one or more transdermal patches).

The container may include any appropriate access member(s) to accommodate the removal of a pharmaceutical product from inside the container (e.g., from within the chamber). Moving the access member relative to a remainder of the container (e.g., relative to the container body) may be utilized to gain access to the chamber (e.g., by exposing an access to the chamber, for instance in the form of an opening). In other words, the access member may be used for selectively allowing or providing access to a chamber that is at least partially defined by the container body (e.g., to add and/or remove pharmaceutical product from within the container body). In an embodiment, the container may be in the form of a bottle (e.g., medicine or pill bottle), and in another embodiment the container may be in the form of a case (e.g., cartridge, receptacle).

The access member may be movable between open and closed positions in any appropriate manner. When the access member is in its closed position, it may enclose pharmaceutical product within the container body. The access member may be characterized as closing off or sealing a chamber in which pharmaceutical product is disposed, and as such the chamber in this case may be characterized as being defined by each of the access member and container body. In one embodiment, the access member and container body are interlocked when the access member is in its closed position (e.g., by a threaded engagement; by a snap-lock; by a locking mechanism). Having the access member interlocked with the container body allows the access member to be retained on the container body even if the container is disposed in an "upside down" position (e.g., the interlock provides at least some resistance to a movement of the access member to its open position).

The access member may be movably and/or detachably interconnected with the container body in any appropriate manner so as to selectively provide access to an interior of the container body (e.g., any appropriate interconnection may be utilized, where the access member may at least partially separate from the container body to provide access to an interior of the container body without damaging either the access member or container body). In an embodiment, the access member may be in the form of a cover (e.g., lid). In one arrangement, the access member may be rotatably attachable to the container body via respective threaded features on the lid and the container body, and in this regard may be selectively attachable to the container body. In an embodiment, the access member may be pivotally interconnected to the container body (e.g., where the access member may be moved between open and closed positions, and yet still remain interconnected with the container body). As an example, any appropriate hinge (e.g., living hinge) may pivotally interconnect the access member to the container body to allow the access member to pivot between at least open and closed positions. In some arrangements, the access member may be both pivotally and rotatably attachable to the container body. For instance, the access member may be threadably connectable to the container body (e.g., rotatably connected) and also be pivotally connectable to the container body via any appropriate resilient member (e.g., a thin, resilient piece of plastic). The access member could also be snap-fit on the container body. In any case, movement of the access member relative to the container body may expose the entirety of the pharmaceutical product within the container body. In one arrangement, the access member may be removed entirely from the container body to expose the entirety of the pharmaceutical product within the container body.

Movement of the access member from a closed position to an open position may expose an open end of a container body through which all pharmaceutical product utilized by the pharmaceutical product container may be introduced into and removed from an interior of the container body. In one embodiment, the pharmaceutical product container may be characterized as a storage apparatus versus a dispensing apparatus, and which is subject to a number of characterizations. The contents of the container may be selected from the group consisting of pharmaceutical product, heat-activated encapsulation material, one or more seals between the pharmaceutical product and the heat-activated encapsulation material, and any combination thereof. It may be such that only pharmaceutical product and the heat-activated encapsulation material (along with any associated seal(s) between the pharmaceutical product and heat-activated encapsulation material) are disposed within the container body. In one embodiment, the pharmaceutical product container does not incorporate any internal componentry or the like for dispensing pharmaceutical product from the container—instead all pharmaceutical product may be manually removed from the interior of the container through an open end of the container body after an associated access member has been moved to an open position.

The heat-activated encapsulation material may be incorporated by or integrated with the pharmaceutical product container in any appropriate manner and at any appropriate location or combination of locations. In one embodiment, the heat-activated encapsulation material is spaced from the pharmaceutical product until it has been heat-activated. Another embodiment has the heat-activated encapsulation material in contact with the pharmaceutical product even prior to its activation. In any case, the heat-activated encapsulation material should not have an adverse effect on the pharmaceutical product prior to its activation. In one embodiment, the melting temperature of the heat-activated encapsulation material is less than the melting temperature of the container body such that the integrity of the container body is not adversely compromised during the encapsulation process.

The heat-activated encapsulation material is subject to a number of other characterizations. For instance, the heat-activated encapsulation material may be in the form of one or more "encapsulation components" operable to at least partially or fully encase or encapsulate the pharmaceutical product, to fixedly seal the container (e.g., fix or bond each access member to the container body), or both, all so as to reduce the potential that the pharmaceutical product will be administered to an individual. Non-limiting examples for the heat-activated encapsulation material include without limitation plastic, wax (e.g., soy wax), adhesive, combinations thereof, and the like which may be in any appropriate form such as layers, sleeves, etc. In one embodiment, heating the container to at least the second melting temperature activates the heat-activated encapsulation material without melting the container body and any associated access member. Use of the phrase "encapsulation component" herein also contemplates use of more than a single encapsulation component.

The heat-activated encapsulation material may be disposable within the container (e.g., within the chamber) or otherwise have access to the pharmaceutical product in any appropriate manner. In an embodiment, the access member may include an inside surface facing towards an interior chamber of the container body, as well as an outside surface facing away from the container, and the heat-activated encapsulation material may be separately incorporated on the inside surface of the access member. For instance, the heat-activated encapsulation material may be appropriately bonded or otherwise attached to the inside surface (e.g., via adhesives, as part of the manufacturing process) of the access member (i.e., the heat-activated encapsulation material is not merely part of the access member in this instance—the heat-activated encapsulation material and access member are separate parts). As another example, the heat-activated encapsulation material may be appropriately disposed within a depression, pocket, or opening formed within or on the inside surface of the access member. In an embodiment, the container body may include an inside surface that faces towards the chamber, and the heat-activated encapsulation material may be disposed on the inside surface of the container body. For instance, the heat-activated encapsulation material may be in the form of a sleeve or liner that may be inserted into or otherwise disposed within the chamber, and may be bonded to the inside surface of the container body.

A fourth aspect of the present invention is directed to a method of preparing a pharmaceutical product for disposal. The pharmaceutical product may be contained within the chamber of at least some of the containers disclosed herein (e.g., the container of the first, second, and third aspects). The method includes heating the container (e.g., to at least the second melting temperature of the heat-activated encapsulation material).

A fifth aspect of the present invention is directed to a method of preparing a pharmaceutical product for disposal. The method includes the steps of detachably securing an access member to a container body (where a pharmaceutical product container includes such an access member and container body), heating the container with pharmaceutical product disposed therein, activating a heat-activated encapsulation material in response to this heating, and encapsulating the pharmaceutical product within the container in response to this activation. The access member and container body are interlocked when detachably secured, and furthermore enclose pharmaceutical product within the container at this time. Encapsulation of the pharmaceutical product within the container includes at least one of: 1) bonding the access member to the container body with the heat-activated encapsulation material; and 2) contacting the pharmaceutical product with the now heated, heat-activated encapsulation material.

A sixth aspect of the present invention is directed to a method of managing pharmaceutical product use. The method includes opening a pharmaceutical product container that includes pharmaceutical product (e.g., a number of individual doses). A first of the pharmaceutical product is removed from the opened container, and the container may then be closed. After one or more individual pharmaceutical products have been removed from the container in this manner, and with the container being in a closed condition or state, the container is heated. Pharmaceutical product that is in the container at this time is encapsulated in at least some fashion in response to the heating of the container.

A number of feature refinements and additional features are separately applicable to each of the fourth, fifth, and sixth aspects of the present invention. These feature refinements and additional features may be used individually or in any combination in relation to each of the fourth, fifth, and sixth aspects. As such, each of the following features that will be discussed may be, but are not required to be, used with any other feature or combination of features of the fourth, fifth, and sixth aspects, respectively.

The pharmaceutical product container may include a container body and an access member. Opening the container may entail moving the access member to an open position, and closing the container may entail moving the access member to a closed position. When the access member is in a closed position, it may be interlocked with the container body in any appropriate manner. Moving the access member to the closed position may establish this interlock.

In an embodiment, any appropriate heating source (e.g., microwave oven) may be utilized to heat the pharmaceutical product container to at least a melting temperature of the heat-activated encapsulation material. In an arrangement, the pharmaceutical product container is not heated to its melting temperature (e.g., to maintain or otherwise reduce degradation of the structural integrity of a container body and access member of the pharmaceutical product container so that such components do not melt while activating the heat-activated encapsulation material). In another arrangement, the heat-activated encapsulation material may be allowed to contact the pharmaceutical product. For instance, the noted heating may allow the heat-activated encapsulation material to melt and drip and/or flow onto the pharmaceutical product. As another example, the heating may allow the heat-activated encapsulation material to at least partially encapsulate the pharmaceutical product or otherwise at least partially surround the pharmaceutical product.

In another arrangement and after any of the above steps of allowing the heat-activated encapsulation material to melt, drip, flow, contact and/or encapsulate the pharmaceutical product, the heat-activated encapsulation material may be allowed to solidify on and/or around the pharmaceutical product. In this regard, the potential for administering the pharmaceutical product to an individual may be reduced as it now may be at least partially encased within a "blob" of plastic or other material making up the heat-activated encapsulation material. For instance and in the case of a transdermal patch being at least partially encased within the heat-activated encapsulation material, a person's skin may not be able to effectively absorb medicines or drugs from the patch due to the presence of the heat-activated encapsulation material, such that the patch may then be less effective in relation to being able to deliver a pharmaceutical transdermally to a patient.

In an embodiment, the container body may include one or more rims, and the method may further include allowing the heat-activated encapsulation material to contact the rim and the access member. In one arrangement, the method may further include allowing the heat-activated encapsulation material to solidify between the rim and the access member to limit removal of the access member from the container body and/or movement of the access member relative to the container body (e.g., to lock or fix the access member to the container body). For instance, the rim or any other bonding surfaces of any appropriate size and shape (e.g., shelves, protrusions, rails, knurled surface) may be disposed on an inside surface of the container body and may aid in non-removably securing the access member to the container body after the heat-activated encapsulation material has flowed and solidified between the access member and the container body. The access member may also include one or more rims, shelves or bonding surfaces.

In an embodiment and before heating the pharmaceutical product container to at least the melting temperature of the heat-activated encapsulation material or heating pharmaceutical product within the pharmaceutical product container, the method may include limiting access into and out of a chamber (in which the pharmaceutical product is disposed) with the access member (e.g., covering or closing off the chamber with the access member). This step may include removably securing the access member to the container body. For instance, the access member and container body may include corresponding interlocking members (e.g., snaps, springs, tabs, slots, threaded portions) that may be operable to interact with each other to removably secure the access member to the container body by an interlocking relation. In an embodiment and after the heating of the pharmaceutical product container, the pharmaceutical product container may be allowed to cool for a sufficient time (e.g., to allow for a change in phase or state). For example, the pharmaceutical product container may be allowed to cool for a period of time that allows the heat-activated encapsulation material to harden or otherwise solidify after it was heated to at least its melting temperature, and thereafter at least partially encapsulate or otherwise contact the pharmaceutical product and/or an intersection of or boundary between the access member and the container body. In any event and in another embodiment, the method may include disposing of the pharmaceutical product container and the pharmaceutical product thereinside to further reduce the potential of any further use of the pharmaceutical product within the pharmaceutical product container.

Activating the heat-activated encapsulation material may include inducing a change in state or phase of the heat-activated encapsulation material. For instance, the ability of the heat-activated encapsulation material to flow may increase by heating the container. The encapsulation material may be a solid at room temperature, and in response to the heating of the pharmaceutical product container the encapsulation material may change to a liquid or liquid-like state or phase. Heating the pharmaceutical product container may cause the encapsulation material to melt. The heat-activated encapsulation material may return to its original state or phase when allowed to cool to an appropriate temperature.

A number of feature refinements and additional features are separately applicable to each of above-noted first, second, third, fourth, fifth, and sixth aspects of the present invention. These feature refinements and additional features may be used individually or in any combination in relation to each of the above-noted first, second, third, fourth, fifth, and sixth aspects of the present invention.

The encapsulation of the pharmaceutical product within the container in response to activation of the encapsulation material, which in turn is in response to heating the container, may be of one or more forms. For instance, this encapsulation may entail fixedly sealing the container (with unused pharmaceutical product therein), may entail fixing or bonding a cover, lid, or the like to a container body (with unused pharmaceutical product therein), may entail having the encapsulation material come into contact with the pharmaceutical product (and including where the pharmaceutical product is at least substantially encased within the encapsulation material), may entail having the encapsulation material bond to the pharmaceutical product, may entail having the encapsulation material bond to the container, or any combination thereof.

A "pharmaceutical product" as used herein may generally define any material or substance used in the course of a medical treatment, medical diagnosis, therapy, or the provision of any other appropriate medical care. A given material need not contain an active drug compound or ingredient to be considered a "pharmaceutical product" for purposes of the present invention.

A pharmaceutical product within the container may be in any appropriate form, in any appropriate dose, and of any appropriate type. A pharmaceutical product encompasses both a single-dose configuration (e.g., a single pill) and a multiple dose configuration (e.g., a plurality of pills). Pharmaceutical product may be in any appropriate form such as (but not limited to) pills, tablets, chewables, capsules, powders, fluids (e.g., liquids, suspensions, emulsions), patches (e.g., transdermal patches), films (e.g., transmucosal or buccal), strips (e.g., transmucosal or buccal), or the like. Further, a "pharmaceutical product" may refer to or include any "drug" as defined in Title 21 of the United States Code, Section 321(g)(1).

All pharmaceutical product within the container may be of at least substantially common dose. Alternatively and for at least some embodiments, some pharmaceutical product could be of one dose (e.g., a prescribed dose), while some pharmaceutical product could be of a different dose (e.g., in the form of a transdermal patch that has been used by a patient, such that at least part of its original dosage has already been transdermally administered to a patient). All pharmaceutical product within the container could be in a common first condition. For instance and in the case of transdermal patches, all transdermal patches within the container could be contained within individual primary packaging (e.g., within a sealed pouch, jacket, foil wrapping, or the like), or all transdermal patches within the container could be in an exposed state (e.g., where the individual transdermal patches have been removed from their associated primary packaging before being disposed within the container) for at least some embodiments. Some pharmaceutical product within the container could be in a common first condition, such as contained within individual primary packaging (e.g., within a sealed pouch, jacket, foil wrapping, or the like), while some pharmaceutical product within the container could be in a common second condition (e.g., in an exposed state or where the individual transdermal patches have been removed from their associated primary packaging before being disposed within the container) for at least some embodiments.

Any transdermal patches utilized with the present invention may include any appropriate pharmaceutical product. Examples of appropriate pharmaceutical products that may be included in such transdermal patches include (but are not limited to): U.S. Drug Enforcement Administration (DEA) scheduled (e.g., Schedule II) drugs such as fentanyl, lidocaine, tetracaine, prilocaine, thebaine, buprenorphine, sufentanil, alfentanil, codeine, dihydrocodeine, hydrocodone, hydromorphone, levorphanol, methadone, morphine, nalbuphine, noscapine, opium, oxycodone, and propoxyphene; non-steroidal anti-inflammatory drugs (NSAIDs) such as ketoprofen, diclofenac, flurbiprofen, and ibuprofen; steroids such as testosterone and estradiol; psychoactive drugs such as buspirone; vitamins such as vitamin B12; vasodilators such as nitroglycerin; vaccines; antiemetics; capsaicin; and nicotine. Further, any transdermal patches utilized with the present invention can function to provide drug delivery in any appropriate manner. For instance, such transdermal patches may include those functioning via a passive delivery mechanism (e.g., pharmaceutical product located within the adhesive of the patch, within a reservoir of the patch, within a semisolid matrix (e.g., a gel)) or via an active delivery mechanism (e.g., iontophoresis, sonophoresis, electroporation, microneedles, abrasion, needle-less injection, suction, stretching, magnetophoresis, radio frequency, lasers, photomechanical waves, temperature (e.g., heat-activation)). The same pharmaceutical product container may be used to store pharmaceutical product for subsequent use by a patient, and may also be used to prepare remaining pharmaceutical product for disposal in accordance with the foregoing (e.g., by activation of the heat-activated encapsulation material). In one embodiment, all pharmaceutical product within the pharmaceutical product container after activation of the heat-activated encapsulation material is of a common dose (e.g., unused pharmaceutical product). All pharmaceutical product within the pharmaceutical product container after activation of the heat-activated encapsulation material may be of a common form. Representative "forms" include without limitation pills, capsules, tablets, caplets, films, or patches. The pharmaceutical product that is encapsulated within the pharmaceutical product container after activation of the heat-activated encapsulation material may be characterized as unused pharmaceutical product (e.g., of a prescribed dose).

Any of the embodiments, arrangements, and the like discussed herein may be used (either alone or in combination with other embodiments, arrangement, and the like) with any of the disclosed aspects. Any feature disclosed herein that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a container includes "a shell" alone does not mean that the container includes only a single shell). Moreover, any failure to use phrases such as "at least one" also does not limit the corresponding feature to the singular (e.g., indicating that a container includes "a shell" alone does not mean that the container includes only a single shell). Use of the phrase "at least generally," "at least partially," or the like in relation to a particular feature encompasses the corresponding characteristic and insubstantial variations thereof (e.g., indicating that an encapsulation component at least partially encapsulates a pharmaceutical product also encompasses the encapsulation component actually encompassing and/or fully encompassing the pharmaceutical product). Finally, a reference of a feature in conjunction with the phrase "in one embodiment" or the like does not limit the use of the feature to a single embodiment.

DETAILED DESCRIPTION

Various embodiments of pharmaceutical product containers will be described in relation to the accompanying figures. These pharmaceutical product containers are configured to store pharmaceutical product as described herein (e.g., in any appropriate form, in any appropriate dose, and of any appropriate type), and furthermore include one or more features to facilitate the disposal of unused pharmaceutical product . Unused pharmaceutical product may be characterized as pharmaceutical product that has not been used in or as part of any dosing event. For instance, unused pharmaceutical product may be in its original or "as prescribed" form, pharmaceutical product in a form as it was intended to be administered to a patient, or the like. In this regard, each of the following embodiments includes a heat-activated encapsulation material that facilitates disposal of a pharmaceutical product container having unused pharmaceutical product contained therein. The heat-activated encapsulation material may bond or fix a cover to a container body (e.g. to fixedly seal the pharmaceutical container product), may come into contact with remaining pharmaceutical product within the pharmaceutical product container (e.g., to encapsulate multiple pharmaceutical product within a common "matrix" of previously activated encapsulation material), or both.

Figure 1:
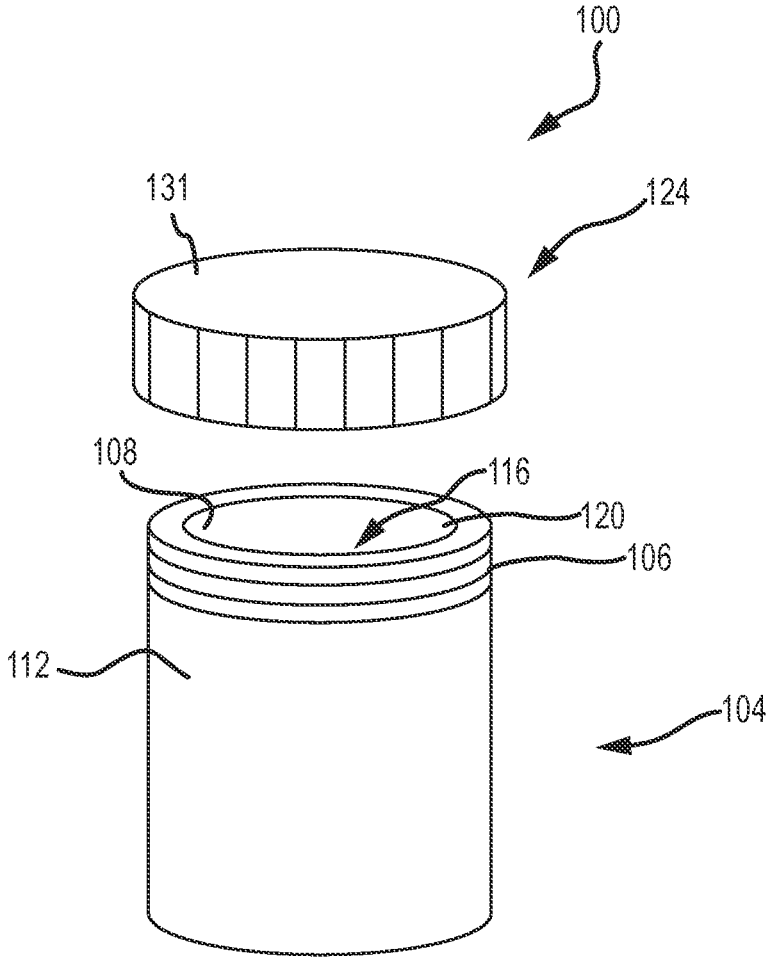
FIG. 1 is a perspective view of one embodiment of a pharmaceutical product container that utilizes a heat-activated encapsulation material.

FIG. 1 presents a perspective view of one embodiment of a pharmaceutical product container 100 for storing pharmaceutical product and that is configured to facilitate disposal of unused pharmaceutical product therein. The container 100 may include a container body which may be in the form of a shell 104 including inside and outside surfaces 108, 112, in addition to a chamber 116 situated within the shell 104 for holding or containing pharmaceutical product. The inside surface 108 may generally face towards the chamber 116, and the outside surface 112 may generally face away from the container 100. Access to the chamber 116 may be provided via an access which may be in the form of an opening 120. The container 100 may also include any appropriate access member which may be in the form of a cover 124 (e.g., lid, top) having a cover body 131 (or access member body) for selectively sealing the chamber 116 or otherwise selectively limiting or allowing access to the opening 120 and any pharmaceutical product inside the chamber 116. The cover 124 may be moved between open and closed positions. When in the closed position, the cover 124 may be characterized as sealing or closing off the chamber 116. As such, the chamber 116 may be characterized as being collectively defined by the shell 104 and cover 124 in its closed position.

The cover 124 may be removably and/or movably interconnected and/or secured to the shell 104 in any appropriate manner. For instance, the shell 104 may include a first securing portion or member 106 (e.g., a first threaded portion) and the cover 124 may include a second securing portion or member 126 (shown in FIG. 2*a*-3*b*, e.g., a corresponding second threaded portion) that is operable to removably interconnect to the first securing member 106 to removably secure the cover 124 to the shell 104. Other types of securing members are also envisioned such as snaps, tabs, springs, or the like to removably secure the cover 124 to the shell 104. Generally and when the cover 124 is in its closed position, the cover 124 and shell 104 may be interlocked in any appropriate manner.

Figures 2A, 2B:
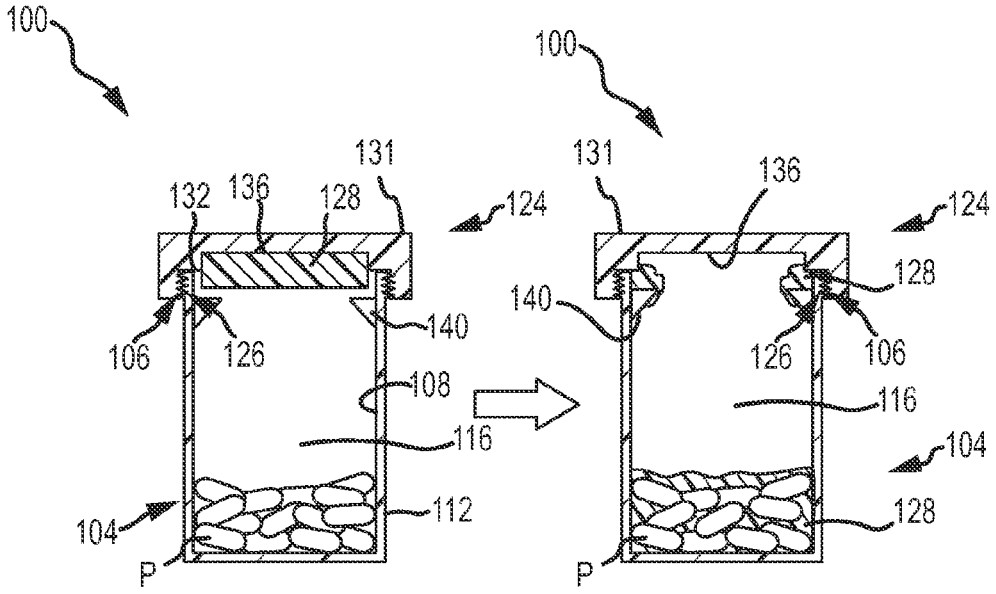
FIG. 2*a* is a cross-sectional view of the pharmaceutical product container of FIG. 1, before activation of the heat-activated encapsulation material.
FIG. 2*b* is a cross-sectional view of the pharmaceutical product container of FIG. 1, after activation of the heat-activated encapsulation material.

Turning now to FIG. 2*a*, a cross-section of the container 100 is shown and illustrates pharmaceutical product (e.g., pills P) being disposed within the interior of the container 100 (e.g., within the chamber 116). Although the remainder of this discussion may refer to "pills P," it is of course equally applicable to all pharmaceutical product as described herein. A heat-activated encapsulation material or component 128 is also disposed within the interior of the container 100. In one embodiment, only pills P and the heat-activated encapsulation material 128 (along with any appropriate seal between the encapsulation material 128 and the pills P) exist within the container 100 in the illustrated embodiment. That is, no other components of the container 100 are located within the interior of the container 100 to facilitate dispensing individual pills P or the like.

It should be appreciated that upon at least movement of the cover 124 relative to the shell 104 (including removal of the cover 124 from the shell 104, or more generally a movement of the cover 124 to an open position), the entirety of the pills P may be freely accessible from the chamber 116 through the opening 120 (not labeled in FIG. 2*a*). That is, the entirety of the pills P may be exposed (e.g., visible) upon removal of the cover 124 from the shell 104. All pills P may be introduced into and removed from the chamber 116 through the opening 120 when the cover 124 is in its open position. The opening 120 may be characterized as being at an open end of the shell 104, and the cover 124 may be characterized as closing this open end when the cover 124 is in its closed position. In one arrangement, part of the process of closing the open end of the shell 104 with the cover 124 may include engaging the first and second securing members 106, 126 (e.g., interlocking the shell 104 and cover 124).

Furthermore, a heat-activated encapsulation material or component 128 (the phrase "encapsulation component" encompasses a single or a plurality of encapsulation components), may be disposed within the chamber 116 and may be operable to, when the container 100 is heated to an appropriate temperature, melt and subsequently flow to one or more areas of or components within the chamber 116. The process of melting and flowing after being heated may be referred to as the encapsulation component 128 being "activated." After a predetermined waiting period, whereby the encapsulation component 128 may be allowed to solidify or otherwise at least partially harden, the pills P may be at least partially encased within the encapsulation component 128. For instance, the shell 104 may have a first melting temperature or point and the encapsulation component 128 may have a second melting temperature or point that is lower than the first melting temperature. By heating the container 100 to at least the second melting temperature, but below the first melting temperature, the encapsulation component 128 may be allowed to melt and flow (i.e., may be activated), while the shell 104 may retain a sufficient portion of its structural integrity, or stated otherwise, degradation of the structural integrity of the shell 104 may be adequately reduced (e.g., the shell 104 should not melt and/or structurally degrade to an undesired degree by this type of heating).

Other components of the container 100 not including the encapsulation component 128 (e.g., the cover body 131) may also be constructed of a material or material that has a melting temperature higher than that of the encapsulation component 128 (i.e., higher than the second melting temperature, such as the first melting temperature or another melting temperature) to reduce degradation of these parts as well. The shell 104 and cover 124, and any other components of the container 100, may be constructed of any appropriate heat resistant materials such as one or more appropriate types of plastic (e.g., high density polyethylene (HDPE), styrene-acrylonitrile (SAN)) and/or any polymers or copolymers suitable for use in injection molding or extrusion processing. In one embodiment, the melting temperature of the encapsulation component 128 is less than a melting temperature of each of the cover 124 and shell 104 such that the integrity of the cover 124 and shell 104 are not adversely compromised during the encapsulation process.

The cover body 131 may include an outside surface (not labeled) operable to generally face away from the container shell 104 and inside surface 132 operable to face generally towards the chamber 116 and/or the pharmaceutical product such as pills P (when the cover 124 is removably attached to the shell 104), and the encapsulation component 128 may be separately incorporated on or otherwise appropriately disposed on the inside surface 132. As used herein, the encapsulation component 128 being "separately incorporated" on the inside surface 132 of the cover body 131 signifies that the encapsulation component 128 is at least partially distinct from the cover body 131 (i.e., the encapsulation component 128 and the cover body 131 are different parts, such that the encapsulation component 128 is not merely part of the cover body 131), but may be movable as a single unit with the cover body 131 (i.e., the encapsulation component 128 and the cover body 131 may be substantially non-movable relative to each other once the encapsulation component 128 has been appropriately incorporated by the cover body 131). In this regard, when the cover 124 is removed from the shell 104, the encapsulation component 128 may be simultaneously removed from the shell 104. Separately incorporating the encapsulation component 128 on the inside surface 132 of the cover body 131 provides numerous advantages such as allowing the cover 124 to be bonded to the shell 104, reducing the risk of misplacement of the encapsulation component 128 (e.g., during transport, during the prescription period), allowing the cover body 131 to be constructed of a material designed to structurally withstand the activation temperature of the encapsulation component 128, etc.

In one embodiment, a portion of the inside surface 132 of the cover body 131 may include an opening, pocket, or depression 136 for receiving the encapsulation component 128. For instance, the encapsulation component 128 may be press-fit into the depression 136 and/or may be attached or bonded to the depression 136 in any appropriate manner (e.g., adhesives, fasteners). In other arrangements, the encapsulation component 128 may be formed on the inside surface 132 of the cover body 131 as part of the manufacturing process of the cover 124. In a further arrangement, a portion of the inside surface 132 of the cover body 131 may include slots, grooves, rails, or the like operable to receive portions of the encapsulation component 128. For example, the encapsulation component 128 may be conveniently inserted or slid into such slots or press-fit into the depression 136 by a pharmacist or other personnel. In another arrangement, the encapsulation component 128 may be disposed on a substantial majority of the inside surface 132. In any event, the encapsulation component 128 may be disposed on the inside surface 132 of the cover body 131 in a manner that at least allows the encapsulation component 128 to, when heated to an appropriate temperature, 1) melt and flow into the chamber 116 to at least contact and/or at least partially encase, encapsulate or otherwise solidify around the pills P and/or other pharmaceutical product contained or received in the chamber 116 and/or 2) solidify between the cover 124 and the shell 104 to substantially non-removably bond the cover 124 to the shell 104.

With continued reference to FIG. 2*a*, the inside surface 108 of the shell 104 may include one or more bonding surfaces or stops 140 (e.g., rim, shelf) disposed at least partially thereabout near an upper portion of the shell 104 (e.g., near where the cover 124 removably interconnects to the shell 104). Broadly, the bonding surface(s) 140 may allow the encapsulation component 128 to rigidly or otherwise at least partially non-removably bond the cover 124 to the shell 104 to thereby limit access to the chamber 116 and any pharmaceutical product thereinside after the container 100 has been heated to at least the second melting temperature as will be described in more detail below. Alternatively, the bonding surface 140 may simply be an upper portion of the shell 104 (e.g., near where the cover 124 removably interconnects to the shell 104). In this regard, rims, shelves or other protrusions may not be needed to bond the cover 124 to the shell 104 upon heat-activation of the encapsulation component 128.

Turning now to FIG. 2*b*, a cross-section of the container 100 is illustrated after the container 100 has been heated to at least the second melting temperature, but less than the first melting temperature, and has thereafter been allowed to cool for a predetermined period of time. As can be seen, the encapsulation component 128 has dripped and/or flowed onto, solidified around, and encapsulated or encased the pills P within the chamber 116 so as to form a hardened "blob" of the pills P and the encapsulation component 128. That is, the potential of the pills P being administrable to an individual in the intended manner (e.g., where individual pills P are swallowed by a patient) should now be reduced, and thus the likelihood of illicit use of the pills P should now be reduced. The heat-activated encapsulation component 128 could also be bonded to the interior of the shell 104 at this time and/or the pills P themselves, further reducing the potential that the pills P will be administered to an individual. It is also contemplated that as part of the process of heating the container 100, properties (e.g., physical, chemical) of the pills P may be modified to render the pills P less potent or to otherwise make the pills P more difficult to administer. For instance, one or more active ingredients in the pills P may be neutralized as part of the heating process.

With continued reference to FIG. 2*b*, portions of the encapsulation component 128 have also dripped onto and solidified between the bonding surface 140 and portions of the inside surface 132 of the cover body 131. The cover 124 has thus become at least substantially rigidly and non-removably attached to the shell 104, which should limit access to the chamber 116 and any pills P inside. It should be appreciated that the encapsulation component 128 can be appropriately disposed on the inside surface 132 of the cover body 131 in a manner so as to flow and solidify onto the bonding surface(s) 140, onto the pills P, or onto both the bonding surface(s) 140 and the pills P. In any event, the container 100 may at this point be thrown away in a standard trash receptacle or otherwise disposed of to further reduce the likelihood of illicit usage of the pills P.

The encapsulation component 128 may be of any form such that the encapsulation component 128 can be efficiently disposed within the chamber 116 and/or disposed over a portion of the inside surface 132 of the cover body 131 or inside surface 108 of the chamber 116. As shown in FIG. 2*a*, the encapsulation component 128 may be in the form of a layer that extends across a substantial portion of the inside surface 132 of the cover body 131 so as to drip and/or flow (when the container 100 is heated to at least the second melting temperature) across a substantial portion of a width and/or cross-sectional profile (not labeled) of the chamber 116 so as to contact at least most of any pills P inside the chamber 116. Other shapes and arrangements are also contemplated such as multiple layers, multiple separated blobs, and the like. The encapsulation component 128 may also be of any material (e.g., plastics, wax, adhesives) that has a melting temperature lower than a melting temperature of the material making up the shell 104, cover body 131 and other components of the container 100.

Figures 3A, 3B:
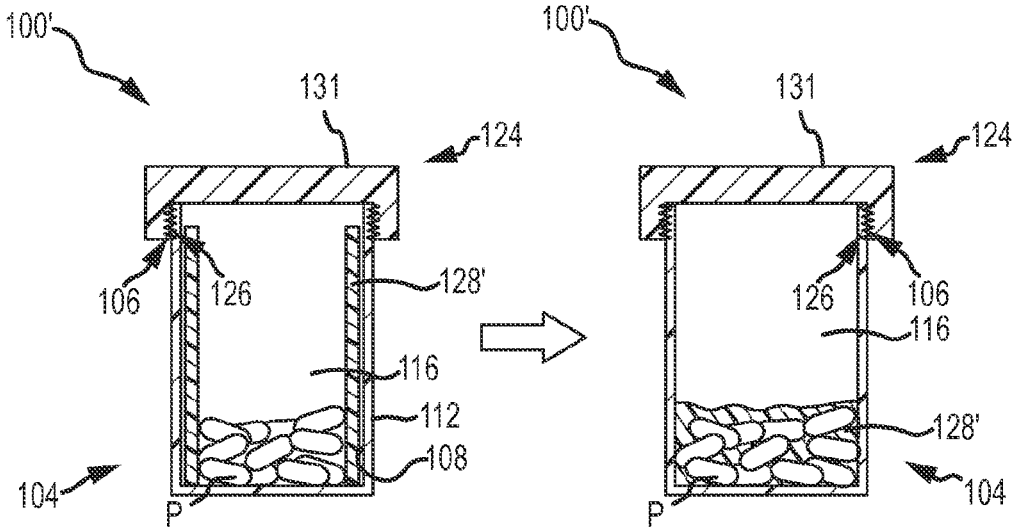
FIG. 3*a* is a cross-sectional view of another embodiment of a pharmaceutical product container that utilizes a heat-activated encapsulation material, and before activation of the same.
FIG. 3*b* is a cross-sectional view of the pharmaceutical product container of FIG. 3*a*, after activation of the heat-activated encapsulation material.

FIGS. 3*a* and 3*b* present another embodiment of a pharmaceutical product container 100' for storing pharmaceutical product and that is configured to facilitate disposal of unused pharmaceutical product therein. Corresponding components between the embodiments of FIGS. 2*a*/2*b* and 3/3*b* are identified by common reference numerals. Those corresponding components that differ in at least some respect from the embodiment of FIGS. 1, 2*a* and 2*b* are identified by a "single prime" designation in FIGS. 3*a* and 3*b*. As with the container 100, the one or more components of the container 100' may be of any appropriate size, shape, configuration and/or type. One difference between the container 100 of FIGS. 2*a-b* and the container 100' of FIGS. 3*a-b* is the use of an encapsulation component 128' in the form of a sleeve or liner that may be inserted into the chamber 116 of the shell 104. For instance, the encapsulation component 128' may be sized to have a diameter and/or cross-sectional profile that is approximately equal to a diameter and/or cross-sectional profile of the chamber 116, such that the pills P may be disposed within the encapsulation component 128'. Although not illustrated, the encapsulation component 128' may also extend across a bottom surface (not labeled) of the shell 104. The encapsulation component 128' may be removably disposed in the chamber 116 or may be appropriately attached to the inside surface 108 of the shell 104 (e.g., via adhesives, as part of the manufacturing process of the container 100). Similar to the embodiment of FIGS. 1, 2*a* and 2*b*, and with reference now to FIG. 3*b*, the container 100' may be heated to at least the second melting temperature (e.g., of the encapsulation component 128'), but less than the first melting temperature (of the shell 104 and/or cover body 131), to allow the encapsulation component 128' to drip and/or flow onto the pills P within the chamber 116. The pills P may be at least partially encapsulated after the encapsulation component 128' has been allowed to harden or otherwise solidify (e.g., form a "blob" with the pills P). Although not shown, an encapsulation component 128' may be appropriately disposed (e.g., separately incorporated) on the inside surface 132 of the cover body 131 and/or the container 100' may be equipped with a depression 136 in the cover 124 and/or one or more bonding surfaces 140 for reasons as previously discussed.

Figure 4:
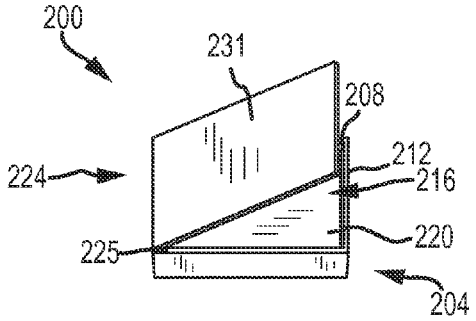
FIG. 4 is a perspective view of another embodiment of a pharmaceutical product container that utilizes a heat-activated encapsulation material.

FIG. 4 presents a perspective view of another embodiment of a pharmaceutical product container 200 (e.g., case) for storing pharmaceutical product and that is configured to facilitate disposal of unused pharmaceutical product therein. When possible, similar components between this embodiment and previous embodiments will be represented with similar reference numerals (e.g., shell 104 and shell 204) and doing so may imply that the feature may include similar qualities (e.g., similar forms, shapes, melting temperatures). The container 200 may include a container body in the form of a shell 204 including inside and outside surfaces 208, 212, in addition to a chamber 216 situated within the shell 204 for holding or containing pharmaceutical product such as one or more new and/or used transdermal patches TP. The inside surface 208 may generally face towards the chamber 216 and the outside surface 212 may generally face away from the container 200. Access to the chamber 216 may be provided via an access in the form of an opening 220.

The container 200 may also include an access member in the form of a cover 224 (e.g., lid, top) having a cover body 231 for selectively sealing the chamber 216 (or otherwise selectively limiting and/or allowing access to the opening 220) and may be interconnected to the shell 204 in any appropriate manner. For instance, the cover 224 may be pivotally interconnected to the shell 204 by way of a living hinge 225 or other appropriate device(s). Moreover, the shell 204 and cover 224 may respectively include corresponding first and second securing members 226, 227 (e.g., snaps, tabs, springs, best seen in FIG. 5*a*) that collectively function to selectively removably attach the cover 224 to the shell 204 and seal or otherwise limit access to the chamber 216 (e.g., the cover 224 and shell 204 may be interlocked when the cover 224 is in its closed position). Other arrangements are contemplated, such as allowing the cover 224 to be selectively completely removed from the shell 204 and then removably attached to the shell 204 by way of a press-fit arrangement, snaps, tab, springs and the like. This type of "detachable" interconnection allows the cover 224 and shell 204 to be assembled and disassembled on a repeated basis and without damaging either the cover 224 or shell 204.

Figure 5A:
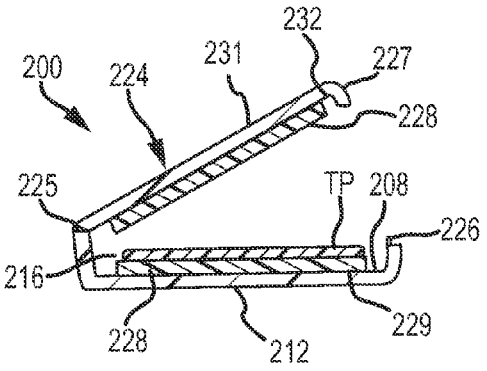
FIG. 5*a* is a cross-sectional view of the pharmaceutical product container of FIG. 4, before activation of the heat-activated encapsulation material.

FIG. 5*a* presents a cross-section of the container 200 and illustrates a pharmaceutical product such as a transdermal patch TP being received within the chamber 216. As shown, the cover body 231 may include an inside surface 232 that may generally face towards the chamber 216 and an encapsulation component 228 of any appropriate form (e.g., layer) may be appropriately separately incorporated on the inside surface 232 (e.g., via adhesives, via a depression such as depression 136 of FIG. 2*a*, as part of the manufacturing process of the container 200). Additionally or alternatively, another encapsulation component 228 may be appropriately disposed (e.g., separately incorporated) on a bottom surface 229 of the shell 204 that generally faces towards the chamber 116 and the inside surface 232 of the cover body 231.

Figure 5B:
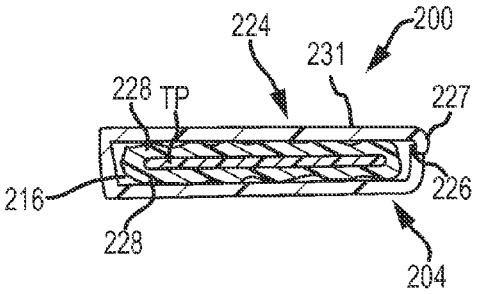
FIG. 5*b* is a cross-sectional view of the container of FIG. 4, after activation of the heat-activated encapsulation material.

Turning now to FIG. 5*b*, a cross-section of the container 200 is illustrated after the cover 224 has been secured to and/or interlocked with the shell 204 via engagement of the first and second securing members 226, 227 (i.e., the cover 224 is substantially non-movable relative to the shell 204) and the container 200 has thereafter been heated to at least the second melting temperature, but less than the first melting temperature (and thereafter been allowed to cool for a sufficient time). As can be seen, the encapsulation components 228 have melted and thereafter solidified around at least a portion of the transdermal patch TP (e.g., "sandwiched" around) so as to at least partially encapsulate or encase the transdermal patch TP, which should reduce the potential of the transdermal patch TP being used to transdermally deliver pharmaceutical to an individual. While not shown, one or more of the first and second securing members 226, 227 may be designed/positioned and/or the encapsulation component(s) 228 can be designed/positioned such that one or more of the encapsulation components 228 may melt and solidify between the first and second securing members 226, 227 to at least substantially non-removably connect the cover 224 to the shell 204 (more generally to bond the cover 224 to the shell 204 when the cover 224 is in the closed position), and thereby limit access to the chamber 216 and any transdermal patches TP disposed therein. In any event, the container 200 may at this point be thrown away in a standard trash receptacle or otherwise disposed of to further limit illicit use of the transdermal patches TP.

Figure 6:
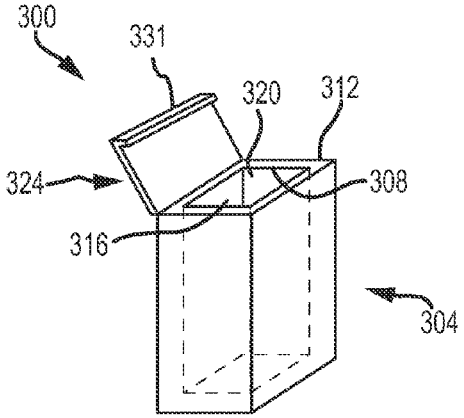
FIG. 6 is a perspective view of another embodiment of a pharmaceutical product container that utilizes a heat-activated encapsulation material.

FIG. 6 presents a perspective view of another embodiment of a pharmaceutical product container 300 (e.g., case) for storing pharmaceutical product and that is configured to facilitate disposal of unused pharmaceutical product therein. When possible, similar components between this embodiment and previous embodiments will be represented with similar reference numerals (e.g., shell 204 and shell 304) and doing so may imply that the feature may include similar qualities (e.g., similar forms, shapes, melting temperatures). The container 300 may include a container body in the form of a shell 304 including inside and outside surfaces 308, 312, in addition to a chamber 316 situated within the shell 304 for holding or containing one or more pharmaceutical products such as one or more new and/or used transdermal patches TP. The inside surface 308 may generally face towards the chamber 316 and the outside surface 312 may generally face away from the container 300. Access to the chamber 316 may be provided via an access in the form of an opening 320. Similar to the container 200, the container 300 may also include an access member in the form of a cover 324 (e.g., lid, top) having a cover body 331 for selectively sealing the chamber 316 (or otherwise selectively limiting and/or allowing access to the opening 320) and may be interconnected to the shell 304 in any appropriate manner (e.g., pivotally). Although not labeled, the shell 304 and cover 324 may respectively include corresponding securing members (e.g., those discussed in relation to the embodiment of FIGS. 1-5B) to selectively removably attach the cover 324 to the shell 304 and seal or otherwise limit access to the chamber 316 (e.g., before heating of encapsulation component 328, discussed below). As such, the cover 324 and shell 304 may be interlocked when the cover 324 is in its closed position.

Figure 7A:
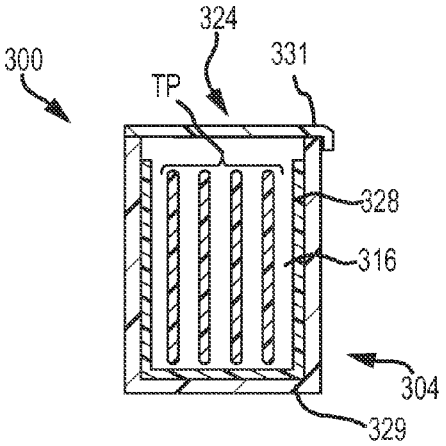
FIG. 7*a* is a cross-sectional view of the pharmaceutical product container of FIG. 6, before activation of the heat-activated encapsulation material.

Turning now to FIG. 7*a*, a cross-section of the container 300 is shown and illustrates a number of pharmaceutical products, such as transdermal patches TP, being received within the chamber 316. As shown, an encapsulation component 328 in the form of a sleeve or liner may be appropriately disposed within the chamber 316. The encapsulation component 328 may extend substantially from one side (not labeled) of the chamber 316 to an opposite side (not labeled) of the chamber 316. In other words, the encapsulation component 328 may be sized to have a diameter and/or cross-sectional profile that is approximately equal to a diameter and/or cross-sectional profile of the chamber 316, such that the transdermal patches TP may be inserted into or otherwise disposed within the encapsulation component 328. As also shown, the encapsulation component 328 may extend across a bottom surface 329 of the shell 304. Although not illustrated in FIG. 7*a*, the encapsulation component 328 may also extend from one end (not labeled) of the chamber 316 to an opposite end (not labeled) of the chamber 316. In this regard, the encapsulation component 328 may be designed to cover or otherwise be disposed over at least a portion of most or all of the inside surface 308 (e.g., two sides and two ends) of the shell 304. The encapsulation component 328 (or another encapsulation component 328) may be removably disposed in the chamber 316 or may be appropriately attached to or separately incorporated on the inside surface 308 of the shell 304 (e.g., via adhesives, as part of the manufacturing process of the container 300).

Figure 7B:
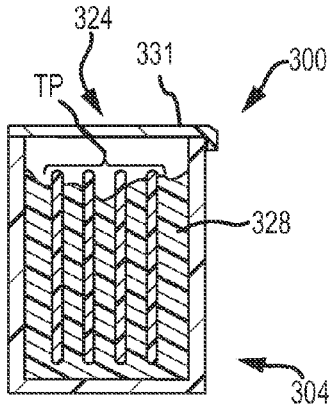
FIG. 7*b* is a cross-sectional view of the pharmaceutical product container of FIG. 6, after activation of the heat-activated encapsulation material.

FIG. 7*b* is a cross-section of the container 300 after the cover 324 has been secured to the shell 304 (e.g., via respective securing members on the shell 304 and the cover 324, such that the shell 304 and cover 324 are interlocked) and the container 300 has thereafter been heated to at least the second melting temperature, but less than the first melting temperature (and thereafter been allowed to cool for a predetermined period of time). As can be seen, the encapsulation component 328 has melted and thereafter solidified around at least a portion of the transdermal patches TP (e.g., "sandwiched" around) so as to at least partially encapsulate or encase the transdermal patches TP, which should reduce the potential of the transdermal patches TP being used to transdermally delivery pharmaceutical to an individual. The container 300 may at this point be appropriately disposed of (e.g., deposited in a trash receptacle) to further reduce the chance of illicit usage of the transdermal patches TP. Although not shown, one or more encapsulation components 328 may be separately incorporated on an inside surface (not labeled) of the cover body 331 which may melt and flow onto the transdermal patches TP and/or securing members or other structures to, after solidifying, further render the transdermal patches TP at least partially unusable and/or non-removably interconnect the cover 324 to the shell 304 to limit access to the chamber 316 and the transdermal patches TP. In some arrangements, the chamber 316 may include one or more ribs or rails attached to the inside surface 308 to define a number of slots, each of which can receive one or more transdermal patches TP or other pharmaceutical products. In this arrangement, one or more encapsulation components 328 may be disposed in each such slot so as to melt around and at least partially encapsulate a transdermal patch TP when the container 300 has been heated to at least the second melting point.

It should be appreciated that various components discussed herein may be utilized with embodiments other than those with which the various components have been illustrated. For instance, the bonding surface 140 of FIGS. 2*a* and 2*b* may be utilized in other embodiments to assist in rigidly securing any of the covers to any of the shells. The encapsulation components may be disposed on the inside surface of any of the covers. As another example, any of the covers may be non-movably secured to or interlocked with the shells (e.g., via the above discussed corresponding securing members) before the containers are heated to at least the melting temperature of the heat-activated encapsulation material or component. As a further example, it is contemplated that the container may further include another encapsulation component having a third melting temperature that may also be less than the first melting temperature and may be the same or different than the second melting temperature of the first-noted encapsulation component. This may be useful with containers having multiple compartments where it may be desired that, upon heating the container, the encapsulation component of one compartment is activated (e.g., melts) while that of another compartment does not. At a later point in time, a user may again heat the container to the third melting temperature (assuming it is higher than the second melting temperature) to activate the second material to encapsulate pharmaceutical products in the other compartment. Other arrangements are also envisioned.

Figure 8:
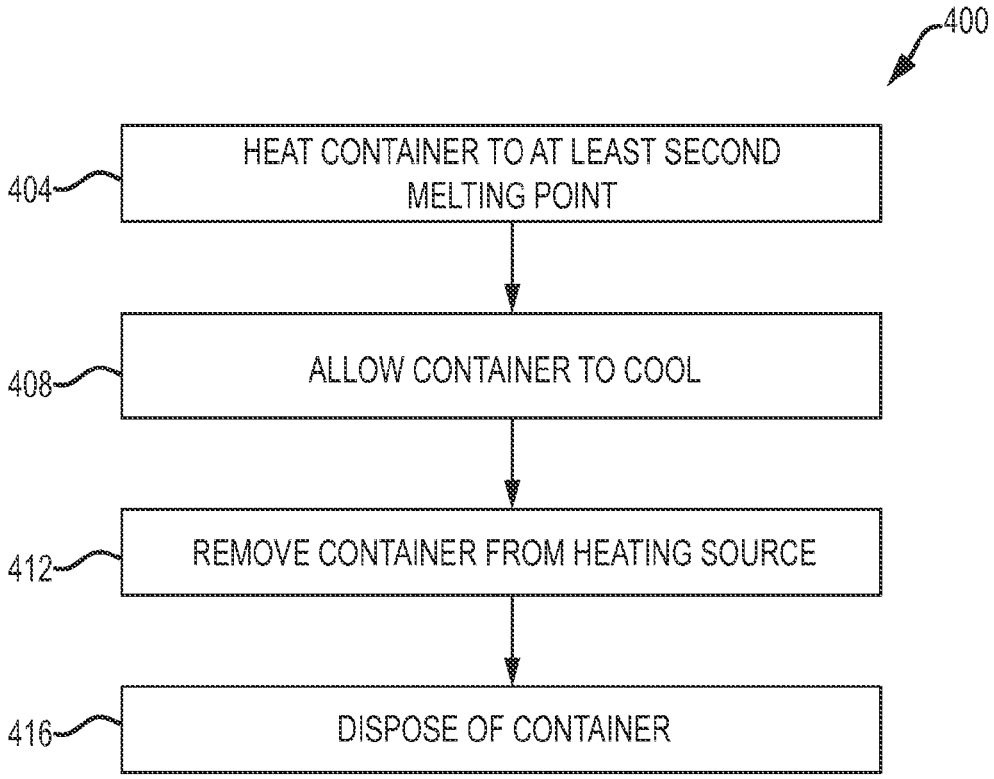
FIG. 8 is a flow diagram of a method of disposing unused pharmaceutical product, for instance using any of the pharmaceutical product containers of FIGS. 1-7*b*.

Turning now to FIG. 8, one method 400 for disposing unused pharmaceutical product (e.g., using any of the containers disclosed herein) is illustrated, although it will be appreciated that numerous other methods of using the containers disclosed herein are contemplated. In step 404, any of the containers disclosed herein (with one or more pharmaceutical products (e.g., pills, capsules, patches) contained within the chamber and the access member or cover being closed and/or interlocked with the container body) may be appropriately heated (e.g., by or within a heating source) to at least the second melting temperature (e.g., the melting temperature of the encapsulation component). For instance, step 404 may include engaging the above-discussed first and second securing members (e.g., threading the cover onto the shell; interlocking a cover with a container body) to limit access into and out of the chamber and then placing the container into a microwave oven and heating the container on a particular power level for a particular amount of time (e.g., few minutes) to achieve the second melting temperature (of the encapsulation component) but not the first melting temperature of the container body (i.e., to activate the encapsulation component without melting relevant structure of the container). It should be appreciated that this step may depend upon voluntary participation by a user. That is, the pharmaceutical products may not be rendered unusable and thus the user may freely access the pharmaceutical products until the user chooses to heat the container to at least the second melting temperature. In any event and as part of step 404, the encapsulation component may be allowed to melt so as to drip or flow and contact the one or more pharmaceutical products. Additionally or alternatively, the encapsulation component may be allowed to melt and contact a bonding surface (e.g., rim, shelf) or securing member of the shell and/or cover (e.g., to bond a cover to a container body in any appropriate manner).

After step 404, the container may be allowed to cool for a sufficient period of time in step 408. For instance, the container may be allowed to cool for a period of time necessary for the encapsulation component to encapsulate and/or solidify around the one or more pharmaceutical products and/or between the bonding surface(s) and/or securing members to non-removably secure the cover to the shell or otherwise limit removal of the cover from the shell (e.g., few minutes). The container may then be removed from the heating source in step 412 and may be appropriately disposed of (e.g., thrown into a trash receptacle) in step 416 to further reduce the chances of illicit usage of the pharmaceutical products.

Based upon the foregoing, it should be appreciated that the same container that is used to store pharmaceutical product during a dosing regimen by a patient may be used to dispose of pharmaceutical product. All pharmaceutical product within the container after preparation for disposal in accordance with the foregoing may be of a common form (e.g., in the form of a pill, tablet, caplet, capsule, film, or patch). Moreover, all pharmaceutical product within the container after preparation for disposal in accordance with the foregoing may be of a common dose (e.g., of the prescribed dose or "unused" pharmaceutical product).

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such or other embodiments and with various modifications required by the particular application(s) or use(s) of the present invention. It is intended that the appended claims be construed to include alternative embodiments to the extent permitted by the prior art.

What is claimed:

1. A method of managing pharmaceutical product use, comprising the steps of:

opening a pharmaceutical product container comprising a first melting temperature, wherein said pharmaceutical product container comprises a container body and an access member, wherein said opening step comprises moving said access member to an open position to provide access to a chamber within said container body, wherein a plurality of individual pharmaceutical product components are stored within said chamber, wherein each said pharmaceutical product component is an individual dose, and wherein a heat-activated encapsulation component is also disposed within said chamber and has a second melting temperature that is lower than said first melting temperature of said pharmaceutical product container;

removing a first said pharmaceutical product component from said chamber of said pharmaceutical product container after said opening step;

closing said pharmaceutical product container after said removing step, wherein said closing step comprises moving said access member to a closed position to close off said chamber;

heating said pharmaceutical product container after said closing step, wherein said heating step comprises heating said heat-activated encapsulation component to a temperature that is above said second melting temperature of said heat-activated encapsulation component but that is lower than said first melting temperature of said pharmaceutical product container; and encapsulating said pharmaceutical product components remaining within said chamber of said pharmaceutical product container after said closing step and in response to said heating step.

2. The method of claim 1, wherein said closing step comprises interlocking said access member with said container body.

3. The method of claim 1, wherein said closing step comprises detachably securing said access member to said container body.

4. The method of claim 3, wherein said detachably securing step further comprises threading said access member onto said container body.

5. The method of claim 1, wherein said encapsulating step comprises at least one of bonding said access member to said container body with encapsulation material from a melting of said heat-activated encapsulation component by said heating step, and contacting said pharmaceutical product components remaining in said pharmaceutical product container with said encapsulation material.

6. The method of claim 1, wherein said encapsulating step comprises both bonding said access member to said container body with encapsulation material from a melting of said heat-activated encapsulation component by said heating step, and contacting said pharmaceutical product components remaining in said pharmaceutical product container with said encapsulation material.

7. The method of claim 1, wherein said encapsulating step further comprises allowing encapsulation material, from a melting of said heat-activated encapsulation component by said heating step, to solidify around said pharmaceutical product components remaining within said pharmaceutical product container.

8. The method of claim 1, wherein said encapsulating step further comprises allowing encapsulation material, from a melting of said heat-activated encapsulation component by said heating step, to solidify between said container body and said access member.

9. The method of claim 1, wherein said heat-activated encapsulation component is separately incorporated on said access member.

10. The method of claim 1, further comprising:

allowing said pharmaceutical product container to cool after said heating step.

11. The method of claim 1, further comprising:

disposing of said pharmaceutical product container, along with said pharmaceutical product components remaining within said pharmaceutical product container, after said heating step.

12. The method of claim 1, wherein said heating step comprises using a microwave oven.

13. The method of claim 1, wherein said encapsulating step comprises fixedly sealing said pharmaceutical product container.

14. The method of claim 1, wherein each said pharmaceutical product Component is selected from the group consisting of a pill, a capsule, a caplet, a tablet, and a patch.

15. A method of managing pharmaceutical product use, comprising the steps of:

opening a pharmaceutical product container comprising pharmaceutical product, wherein each said pharmaceutical product is selected from the group consisting of a pill, a capsule, a caplet, a tablet, and a patch;

removing a first of said pharmaceutical product from said pharmaceutical product container after said opening step;

closing said pharmaceutical product container after said removing step;

heating said pharmaceutical product container after said closing step; and encapsulating said pharmaceutical product remaining within said pharmaceutical product container after said closing step and in response to said heating step.

16. The method of claim 15, wherein said pharmaceutical product container comprises a container body and an access member, wherein said opening step comprises moving said access member to an open position, and wherein said closing step comprises moving said access member to a closed position.

17. The method of claim 16, further comprising the step of:

activating a heat-activated encapsulation material disposed inside said pharmaceutical product container in response to said heating step.

18. The method of claim 17, wherein said encapsulating step comprises at least one of bonding said access member to said container body with said heat-activated encapsulation material, and contacting said pharmaceutical product remaining in said container with said heat-activated encapsulation material.

19. The method of claim 15, further comprising:

disposing of said pharmaceutical product container, along with said pharmaceutical product remaining within said pharmaceutical product container, after said heating step.

20. The method of claim 15, wherein said heating step comprises not heating said pharmaceutical product container above a melting temperature of said pharmaceutical product container.

* * * * *